United States Patent [19]

Bryan et al.

[11] Patent Number: 4,535,717

[45] Date of Patent: Aug. 20, 1985

[54] MARINE SURFACE DEBRIS DEFLECTOR

[75] Inventors: Darold R. Bryan, Seattle; George Z. Porter, Bellevue, both of Wash.

[73] Assignee: The Boeing Company, Seattle, Wash.

[21] Appl. No.: 562,027

[22] Filed: Dec. 14, 1983

Related U.S. Application Data

[63] Continuation of Ser. No. 318,718, Nov. 6, 1981, abandoned.

[51] Int. Cl.[3] ..... B63B 35/38

[52] U.S. Cl. ..... 114/230; 114/263; 114/258

[58] Field of Search ..... 114/263, 230, 258, 61; 405/219, 220, 221, 211, 218, 60, 63, 60.5

[56] References Cited

U.S. PATENT DOCUMENTS

| | | | |
|---|---|---|---|
| 159,328 | 2/1875 | Irvine | 405/60.5 |
| 2,745,118 | 5/1956 | Potts et al. | 114/61 |
| 3,009,326 | 11/1961 | Williams | 405/219 |
| 3,354,479 | 11/1967 | Koppenol et al. | 405/218 |
| 3,961,593 | 6/1976 | Matthews | 114/219 |
| 4,290,382 | 9/1981 | Conti et al. | 114/263 |
| 4,292,005 | 9/1981 | Boksjö114 | 263/ |

*Primary Examiner*—Trygve M. Blix
*Assistant Examiner*—C. T. Bartz
*Attorney, Agent, or Firm*—William C. Anderson

[57] ABSTRACT

Apparatus for removing or deflecting surface debris (D) from the moorage site of, e.g., a hydrofoil watercraft (5) having a water-jet propulsion system. Debris (D) is diverted away from the hull inlet (72) of the propulsion system and/or cooling water inlets and/or positions proximate the craft (5) which may interfere with the operation of a forward and an aft strut assembly (15,20) by means of a catamaran pontoon (95). The pontoon (95) is provided with an open-ended debris-conducting channel (100) into which surface debris (D) is guided by a pair of fixed debris guides (105B, 105F). A plurality of elevated stand-offs (115) are supported by the pontoon (95) precluding damage to the craft (5) and the accumulation of surface debris (D) proximate the craft (5). Optionally, retractable debris guides (120B, 120F) may be pivotably attached to the guides (105B, 105F) affording the moorage site greater isolation from surface debris (D).

6 Claims, 7 Drawing Figures

MARINE SURFACE DEBRIS DEFLECTOR

This application is a continuation of U.S. patent application Ser. No. 318,718, filed Nov. 6, 1981, now abandoned.

TECHNICAL FIELD

This invention relates to a system for protecting a watercraft and more particularly relates to an apparatus for diverting surface debris from the proximity of a watercraft having water ingesting apparatus.

BACKGROUND OF THE INVENTION

An illustrative hydrofoil watercraft has submerged strut-supported foils which move through the water during flight, i.e., during foil-borne operation of the craft the foils develop lift comparable to an airplane wing. Such craft may be operated at relatively high speeds by means of, e.g., a waterjet propulsion system. In such a system water is drawn or ingested into a water intake and directed to a pump which accelerates and discharges the water rearwardly in a high velocity jet resulting in a forwardly directed propulsion force.

Such a hydrofoil craft may be moored in relatively shallow water by retracting the struts into recesses appropriately located in the bow and stern of the craft. Experience has found that the accumulation of surface debris in the vicinity of a moored hydrofoil craft can cause serious problems especially when the craft employs a waterjet propulsion system. Surface debris can either be sucked from the surface of the water into the water intake, ingested or lodged in the waterjet propulsion system or can interfere with the strut actuation mechanism resulting in unscheduled delays and potentially costly repairs. In addition, debris can cause a blockage of the seawater cooling system of the watercraft (if so equipped) resulting in damage or loss of equipment being cooled on the watercraft.

SUMMARY OF THE INVENTION

The present invention provides an apparatus for diverting surface debris from a water-ingesting watercraft moored proximate a dock and comprises an open-ended channel disposed proximate the craft and a pair of debris deflecting guides or deflectors for directing the debris into the channel. By deflecting the surface debris, the accumulation of surface debris and the associated dangers are substantially minimized.

BRIEF DESCRIPTION OF THE DRAWINGS

The invention will be more fully understood from the following detailed description, taken in connection with the accompanying drawings, in which.

DETAILED DESCRIPTION OF THE INVENTION

Figure 1:
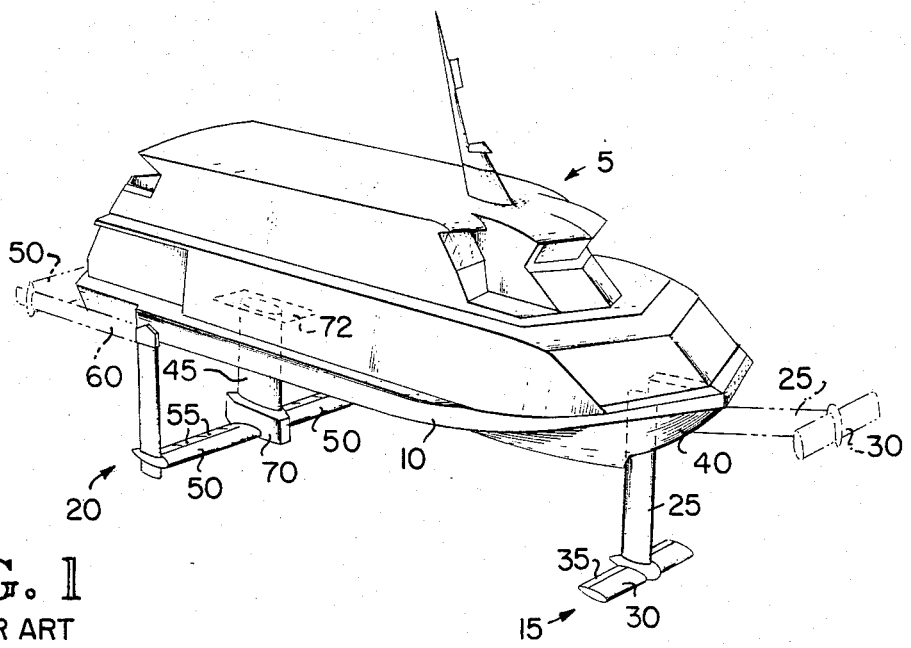
FIG. 1 PRIOR ART
FIG. 1 is a perspective view illustrating one type of hydrofoil watercraft.

Referring now to the following schematic drawings wherein like reference characters designate identical or corresponding parts throughout several views and more particularly to FIG. 1 which exemplifies a hydrofoil watercraft 5. As illustrated in FIG. 1, the watercraft 5 has an appropriately configured hull structure 10 provided with a superstructure of any desired type (not described in detail since not a part of the present invention). The craft 5 is provided with a forward strut assembly 15 disposed in a cavity (only generally represented in FIG. 1) in the bow of the craft and an aft strut assembly 20 fastened near the stern of the craft 5.

The forward strut assembly 15 comprises a steerable and retractable forward strut 25 carrying a forward foil 30 provided with hydrodynamic control surfaces 35. A recess 40, disposed in the bow of the craft 5, allows retraction of the forward strut 25.

The aft strut assembly 20 comprises a central aft strut 45 carrying an aft foil 50 provided with hydrodynamic control surfaces 55. A starboard outboard aft strut 60 and a port outboard aft strut 65 (not shown in FIG. 1) also support the foil 50. The struts 45, 60 and 65 are pivotally attached to the hull structure 10 allowing retraction of the assembly 20. Also attached to the central aft strut 45 is a central water intake 70 for a conventional waterjet propulsion unit (not shown). During use, water enters the intake 70, passes through the strut 45 into a hull inlet 72 and is directed into the ducting (not shown) of the waterjet propulsion unit.

The struts 25, 45, 60 and 65 are shown in FIG. 1 in their vertical or extended position for foil-borne operation (strut 65 is not shown in FIG. 1) in which the foils 30 and 50 move through the water developing sufficient lift to support the hull structure 10 at a desired distance above the water. The control surfaces 35 and 55 are utilized to control the position and motion of the craft and the forward strut 25 is steerable about its vertical axis thereby serving as a rudder.

For hull-borne operation of the craft 5 in, e.g., areas of reduced water depths, the struts 25, 45, 60 and 65 are moved to retracted positions (all struts shown in phantom in FIG. 1 except strut 65). The forward strut 25 retracts by pivotally moving towards the forward direction into the recess 40 in the bow of the craft while the aft strut 45 retracts by moving within a recess 75 (see FIG. 2) disposed in the stern.

Retraction of the aft strut uncovers the hull inlet 72 disposed at the base of the hull directly above the extended position of the central aft strut 45. Due to the high water flow rates and large suctions involved in high performance waterjet propulsion systems, debris can be drawn from the water surface at the sides of the hydrofoil onto or thru an inlet gill (not shown) at the hull inlet 72 thereby interfering with efficient operation of the waterjet propulsion system.

Figure 3:
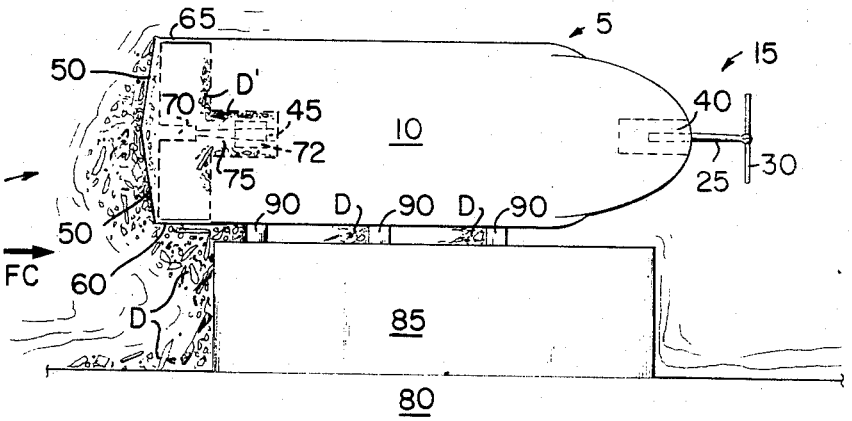
FIG. 3 PRIOR ART
FIG. 3 is a plan view of the moored hydrofoil watercraft illustrating the collection pattern of surface debris with a following current.
Figure 2:
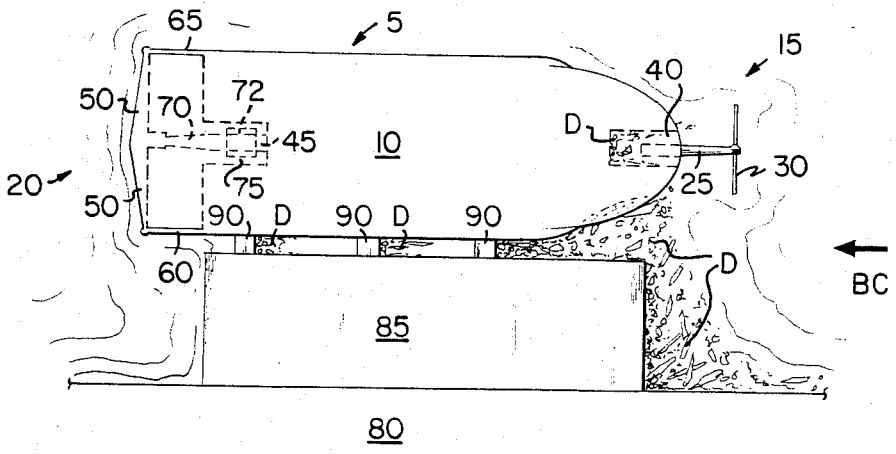
FIG. 2 PRIOR ART
FIG. 2 is a plan view of the hydrofoil watercraft of FIG. 1 moored near the shoreline and illustrating the collection pattern of surface debris with a bow current.

When a hydrofoil watercraft 5 is moored proximate a dock 80 the forward strut assembly 15 and the aft strut assembly 20 are usually retracted as shown in FIGS. 2 and 3. Conventionally, a pontoon 85 is positioned between the craft 5 and the dock 80 to accomodate various tidal conditions and facilitate loading and unloading of the craft. Fendering or protection of the craft 5 is typically provided by means of floating fenders 90 positioned between the pontoon 85 and the craft 5.

It has been found that a bow current, represented by the arrow BC, can carry surface debris (D) to certain areas of a moored hydrofoil craft. As shown in FIG. 2, the debris (D) has been discovered in the cavity 40, along the leading edge of the pontoon 85, around the fenders 90 and under the bow of the craft 5.

It has also been found that when a following current (represented by the arrow FC, see FIG. 3) enters the mooring site and the aft strut assembly 20 is in its retracted position, a substantial amount of debris (D) accumulates aft of the assembly 20. If the aft strut assembly 20 is in its extended position (not shown), surface debris, represented by the letter D', tends to collect aft of the stern of the craft 5 and within the recess 75. Finally, following current debris also tends to collect or accumulate proximate each of the floating fenders 90, as shown in FIG. 3.

As was explained earlier, collection of the surface debris near the hull inlet 72 of the propulsion unit increases the likelihood that the debris could be ingested by the waterjet propulsion unit. Also, collection of surface debris in the recess 40 and/or the recess 75 may interfere with the operation of either the forward strut assembly 15 and/or the aft strut assembly 20, respectively.

Figure 4:
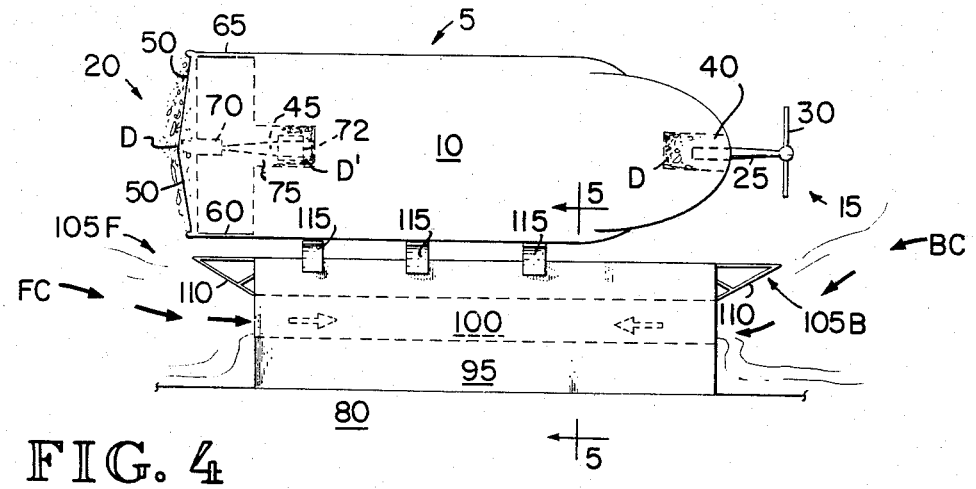
FIG. 4 is a plan view of a moored hydrofoil watercraft illustrating the surface debris deflection system of the present invention.
Figure 5:
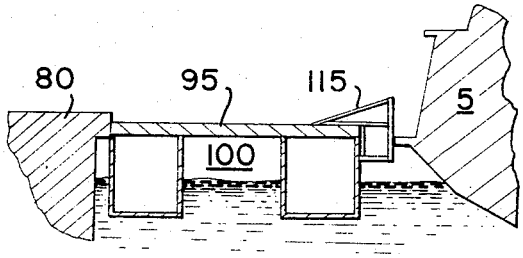
FIG. 5 is a view taken along line 5—5 in FIG. 4.

The apparatus illustrated in FIG. 4 has proven effective in controlling debris in a current or tide flow where the majority of the debris tends to accumulate close to shore, i.e., close to the dock 80. As shown in FIG. 4, a pontoon 95, constructed as a catamaran, is provided with an open-ended elongated passageway or a debris-conducting channel 100 substantially parallel to the craft 5. Fastened to the open ends of the channel 100 are a pair of fixed debris guides 105B and 105F. The guides 105B and 105F, each provided with an inclined surface 110, are adapted to divert or deflect surface debris carried by either a bow current or a following current, respectively, to the channel 100. The optimum angle of inclination of the surface 100 is preferably chosen by experimentation considering the rate of current flow in the mooring site and patterns of debris flow and accumulation. Each of the guides 105B and 105F are fixed to the catamaran pontoon 95 outboard of the channel 100 and proximate the craft 5 whereby substantially all surface debris tending to accumulate along the shoreline is diverted away from the craft 5. Juxtaposed between the pontoon 95 and the craft 5 and affixed to the upper surface of the pontoon 95 are a plurality of elevated standoff members 115. The standoff numbers 115 are disposed above the surface of the water (see FIG. 5) to ensure that any surface debris which may not have been directed by the guides will not be accumulated between the pontoon 95 and the craft 5.

In the mooring site of FIG. 4, experiencing a bow current (BC), substantially all of the debris is funneled or diverted into the channel 100. As can be seen, some debris (D) is collected within the recess 40. However, a minimal amount of debris collected within the recess 40 will not normally interfere with the operation of the forward strut assembly 15.

With a following current (FC) (see FIG. 4) and the aft strut assembly 20 in an up position or retracted position, a minimal amount of debris (D) could be accumulated aft of the assembly 20. Any debris that is collected aft of the assembly 20 will not likely be ingested into the water jet propulsion system hull inlet 72. When the aft strut assembly 20 is in its extended position, the following current will carry debris D' only to the recess 75. However, the amount of debris within the recess 75 does not pose a substantial threat that surface debris will be ingested into the intake 70 because the intake is well below the surface of the water.

Figure 6:
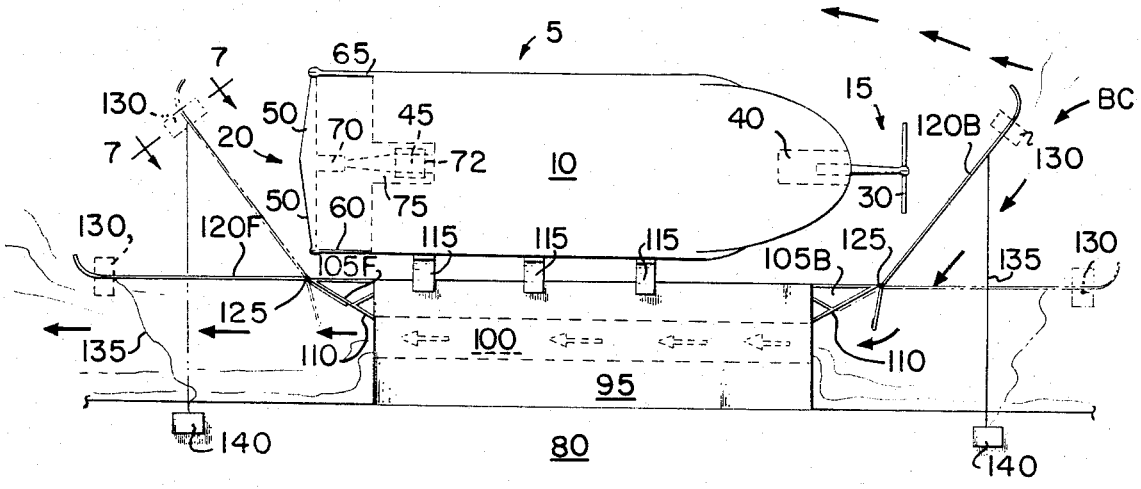
FIG. 6 is a plan view of a hydrofoil watercraft in conjunction with a second and more preferred embodiment of the present invention.

Additional protection of a hydrofoil watercraft 5 may be required in those areas where debris is not only concentrated close to shore, as in FIG. 4, but also flows throughout the entire moorage site. FIG. 6 illustrates an apparatus providing surface debris protection for such a moorage site.

Figure 7:
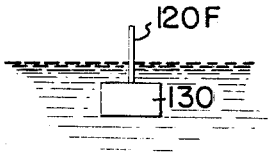
FIG. 7 is a side view taken along line 7—7 in FIG. 6.

In FIG. 6 maximum surface debris control may be effectuated by means of a pair of retractable debris guides 120B and 120F respectively mounted, as by a hinge 125, to the fixed debris guides 105B and 105F. The pivotable ends of the guides 120B and 120F are suitably supported by means of guide floats 130 (see, e.g., FIG. 7). Finally, the elevated standoffs 115 shown in FIG. 5 also ensure that substantially no surface debris is accumulated between the pontoon 95 and the craft 5.

In use, if a bow current, represented by the arrow BC, enters the moorage site of the craft 5, hydrodynamic forces will operate upon the retractable debris guide 120B to cause it to extend within the path of the bow current, as shown in solid lines in FIG. 6, whereby all surface debris will be conducted either to the channel 100 or will be deflected away from the mooring site. The extent to which the guide 120B can travel is restrained as by a line 135. Concomitantly, the retractable debris guide 120F will remain in the retracted position shown in solid lines in FIG. 6 under the influence of the bow current. Advantageously, the guide 120F also precludes the collection of debris on the side of the guide facing the moored craft.

If a following current (not designated in FIG. 6 for purposes of clarity) enters the moorage site, the retractable debris guide 120F will be forced into the extended position shown in phantom in FIG. 6 whereby the following current and any surface debris will be diverted away from the moorage site. Of course, as with the bow current, some of the following current and its surface debris will be diverted through the debris-conducting channel 100. Another guide constraint line 135 limits the travel of the guide 120F into the moorage site. Concomitantly, as the following current flows into the proximity of the moorage site of the craft 5, hydrodynamic forces will move the guide 120B into the retracted position shown in phantom in FIG. 6.

Optionally, a pair of winches 140 may operate on the lines 135 to retract either the guide 120B and/or the guide 120F. This may be desirable at certain times, e.g., when the bow current and/or the following current strength is insufficient to retract either the guide 120B or the guide 120F or when the hydrofoil craft 5 is entering the moorage site.

Obviously numerous modifications and variations of the present invention are possible in light of the above teachings. It is to be understood, for example, that the present invention is not restricted to hydrofoil watercraft but is applicable to any watercraft which ingests water for any reason. It is therefore to be understood that within the scope of the appendent claims the invention may be practiced otherwise than so specificly described.

What is claimed and desired to be secured by Letters Patent of the United States is:

1. An apparatus for diverting debris, borne by a variable direction current water stream, from the proximity of a water-ingesting watercraft employing a waterjet propulsion system, said watercraft being moored adjacent to a dock, located in said water stream, where debris tends to accumulate, said apparatus comprising:

a floatable structure disposable adjacent to said watercraft in said water stream, said structure comprising a first and a second pontoon which are separated to define an internal open-ended channel for conducting debris borne by said variable direction current along a path away from said watercraft, said first pontoon being disposed contiguous to said watercraft and having a surface capable of being presented to said watercraft, said channel having an inlet and an outlet for conducting currentborne debris, and means for guiding debris into said channel, said debris guiding means comprising a deflecting member disposable in said water stream and affixed, at said inlet and at said outlet, to said first pontoon, each of said deflecting members having a first surface extending parallel to and coextensive with said first pontoon surface, each of said deflecting members also having an inclined surface intersecting said first surface and extending toward said channel, whereby debris may be guided away from said watercraft and into said channel.

2. The apparatus of claim 1, further comprising a plurality of vertically extending standoffs juxtaposed between said first pontoon and said moored watercraft, said standoffs being mounted upon said first pontoon above said debris to preclude an accumulation of said debris near said watercraft.

3. The apparatus of claim 1, further comprising:

pivotable means responsive to the directions of flow of said current for divering debris away from said watercraft and/or toward said channel, said current responsive means comprising a pair of floatable extendable debris deflectors, one of said extendable debris deflectors being pivotably attached to one of said deflecting members at the point where said inclined surface intersects said first surface, each of said extendable debris deflectors being of sufficient length to extend across the breadth of said watercraft when pivoted by said current to an extended position contiguous to said watercraft, whereby when one of said extendable debris deflectors is pivoted by said current to an extended position, the other of said extendable debris deflectors is pivoted by said current to a retracted position which is substantially parallel to said channel and coextensive with said one pontoon surface.

4. The apparatus of claim 3, further comprising limiting and retracting means for limiting the pivotable motion of each extendable debris deflector and for aiding in the retraction of a debris deflector that has been extended by said current.

5. The apparatus of claim 4, wherein said limiting and retracting means comprises a pair of fixedly mounted winches, one of said winches having a line fastened to one of said extendable debris deflectors.

6. The apparatus of claim 5, further comprising a plurality of vertically extending standoffs juxtaposed between said first pontoon and said moored watercraft, said standoffs being mounted upon said first pontoon above said debris to preclude an accumulation of said debris near said watercraft.

* * * * *